US009518553B2

(12) United States Patent
Weissenbacher et al.

(10) Patent No.: US 9,518,553 B2
(45) Date of Patent: Dec. 13, 2016

(54) IGNITION DEVICE FOR SPARK IGNITION ENGINES

(71) Applicant: BorgWarner BERU Systems GmbH, Ludwigsburg (DE)

(72) Inventors: Johann Weissenbacher, Obersulm-Sülzbach (DE); Matthias Krause, Fürth (DE); Siegmund Oberer, Berglen-Kottweil (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 328 days.

(21) Appl. No.: 13/963,622

(22) Filed: Aug. 9, 2013

(65) Prior Publication Data

US 2014/0053819 A1 Feb. 27, 2014

(30) Foreign Application Priority Data

Aug. 21, 2012 (DE) ..... 10 2012 107 642
Nov. 21, 2012 (DE) ..... 10 2012 111 234

(51) Int. Cl.

| | |
|---|---|
| ***F02P 1/08*** | (2006.01) |
| ***H01F 27/08*** | (2006.01) |
| ***H01F 38/12*** | (2006.01) |
| ***F28F 3/06*** | (2006.01) |
| *F02P 3/02* | (2006.01) |

(52) U.S. Cl.

CPC .. *F02P 1/08* (2013.01); *F28F 3/06* (2013.01); *H01F 27/08* (2013.01); *H01F 27/085* (2013.01); *H01F 38/12* (2013.01); *F02P 3/02* (2013.01); *F28F 2275/14* (2013.01)

(58) Field of Classification Search

CPC ..... F02P 1/08; H01F 27/085; H01F 27/08; H01F 38/12; F28F 3/06

See application file for complete search history.

(56) References Cited

U.S. PATENT DOCUMENTS

| | | | | | |
|---|---|---|---|---|---|
| 3,765,391 | A | * | 10/1973 | Cook | 123/651 |
| 4,155,340 | A | * | 5/1979 | Fernquist et al. | 123/617 |
| 4,248,201 | A | * | 2/1981 | Tsutsui et al. | 123/647 |
| 4,706,639 | A | * | 11/1987 | Boyer et al. | 123/647 |
| 5,208,541 | A | * | 5/1993 | Yerkovich | F02P 17/12 324/393 |

(Continued)

FOREIGN PATENT DOCUMENTS

| | | |
|---|---|---|
| CN | 1516996 A1 | 7/2004 |
| CN | 202195456 U | 4/2012 |

(Continued)

*Primary Examiner* — Lindsay Low
*Assistant Examiner* — Jacob Amick
(74) *Attorney, Agent, or Firm* — Bose McKinney & Evans LLP

(57) ABSTRACT

The invention relates to an ignition device for an Otto engine, comprising an ignition coil, a printed circuit board, which carries a control circuit with a power transistor, a plastic housing, in which the ignition coil and the printed circuit board are arranged, and a thermal dissipation element, which protrudes through a wall of the plastic housing. In accordance with this disclosure, the printed circuit board carries a cooling body, which is plugged together with the thermal dissipation element to form a thermal bridge, which dissipates thermal losses of the control circuit out from the plastic housing.

22 Claims, 2 Drawing Sheets

(56) References Cited

U.S. PATENT DOCUMENTS

| | | | | |
|---|---|---|---|---|
| 5,348,486 | A * | 9/1994 | Tura, Jr. | H01T 13/05 439/125 |
| 6,882,259 | B1 * | 4/2005 | Klocinski et al. | 336/90 |
| 7,806,738 | B2 * | 10/2010 | Wu et al. | 439/860 |
| 2002/0131238 | A1 | 9/2002 | Fisher et al. | |
| 2011/0044005 | A1 | 2/2011 | Wetzel et al. | |

FOREIGN PATENT DOCUMENTS

| | | | |
|---|---|---|---|
| DE | 83 17 699 | U1 | 11/1984 |
| DE | 37 12 235 | A1 | 10/1988 |
| DE | 101 29 511 | A1 | 1/2003 |
| DE | 10 2007 061 116 | A1 | 6/2009 |
| DE | 10 2010 007 007 | A1 | 8/2011 |

* cited by examiner

IGNITION DEVICE FOR SPARK IGNITION ENGINES

RELATED APPLICATIONS

This application claims priority to DE 10 2012 107642.1, filed Aug. 21, 2012 and DE 10 2012 111234.7, filed Nov. 21, 2012, which are hereby incorporated by reference in their entirety.

BACKGROUND

The invention relates to an ignition device for an Otto engine.

One ignition device known in the art is disclosed in DE 10 2010 007 007 A1. With ignition devices of this type, it is possible to generate a high voltage for a spark plug from an on-board power supply system voltage of a vehicle battery. The ignition coil of such an ignition device operates here by the principle of a transformer, that is to say it has a primary winding that is fed by a vehicle battery, and a secondary winding that is connected to a spark plug.

A thermal loss caused by the currents involved in the voltage transformation and by magnetic fields leads to a considerable temperature load of ignition devices. In addition, there is also a considerable thermal loss in the control circuit of the ignition device, for example, caused by power transistors, which are used to switch the currents.

So that the control circuit of an ignition device can function correctly, it has to be cooled or the thermal loss produced by the control circuit has to be removed from the housing of the ignition device. For this purpose, it is known from DE 10 2010 007 007 A1 to fasten a metal thermal dissipation element to power transistors of the control circuit, said thermal dissipation element protruding from the housing and being fastened by a flange on an engine block so that the coolant of the engine can also cool the thermal dissipation element.

SUMMARY

The present invention provides a way in which the control circuit of an ignition device for an Otto ignition engine can be sufficiently cooled with lower manufacturing effort.

An ignition device according to this disclosure has a cooling body, which is plugged together with a thermal dissipation element protruding through a housing wall of the ignition device to form a thermal bridge. This thermal bridge conducts thermal losses of the control circuit to the outside of the housing of the ignition device. The plugging together of two components for thermal dissipation enables considerably simpler manufacture compared to the production of a single component, which is attached to a power transistor and extends through the housing, like is known from DE 10 2010 007 007 A1.

In accordance with an advantageous refinement of this disclosure, the cooling body is soldered onto a metal surface of the printed circuit board. It is also possible to attach the cooling body on the power transistor or another structural element of the control circuit, however, the manufacturing process can be considerably facilitated if the cooling body is soldered onto a metal surface of the printed circuit board. The cooling body can then be soldered onto the printed circuit board, similarly to other circuit elements, for example, like an SMD (surface mounted device). The metal surface of the printed circuit board is thus itself used to dissipate thermal losses to the cooling body.

The cooling body and the thermal dissipation element may form a tongue and groove connection. The tongue can be clamped in the groove. Thereby, a good connection that conducts heat efficiently can be achieved. The cooling body may provide the tongue and the thermal dissipation element the groove of the tongue and groove connection. It is also possible that the thermal dissipation element provides the tongue and the cooling body the groove of the tongue and groove connection.

In a further advantageous refinement of this disclosure, the cooling body is a strip bent in a U-shaped manner having two branches and holding the thermal dissipation element between its two branches. One of these two branches faces towards the printed circuit board, for example, is soldered thereto or to a power transistor. The other branch faces away from the printed circuit board. Such a tab can be produced cost effectively from sheet metal. The shape of a strip bent in a U-shaped manner has the advantage here that one of the two branches can receive the thermal loss over a large area, for example, since the branch is soldered onto a metal face of the printed circuit board or onto the power transistor of the control circuit. The strip bent in a U-shaped manner additionally enables a plug-in connection with the thermal dissipation element in a simple manner. An extension, for example, a sheet metal strip of the thermal dissipation element, can be plugged between the two branches, where it is held in a clamped manner. Good planar contact between the cooling body and the thermal dissipation element is thus achieved. The cooling body can therefore deliver heat effectively to the thermal dissipation element, which then conducts the thermal loss out from the housing.

In a further advantageous refinement of this disclosure, the power transistor is coupled to a further cooling body. The further cooling body can be arranged completely in the plastic housing and can deliver thermal losses of the power transistor to a wall of the plastic housing, for example, by means of a sheet metal portion that bears against a wall or extends along a wall of the plastic housing. The further cooling body can be attached directly to the power transistor. The further cooling body is preferably attached to the printed circuit board however, for example, is soldered onto the printed circuit board and/or is plugged via extensions into openings in the printed circuit board. It is particularly advantageous to arrange the printed circuit board between the power transistor and the further cooling body.

BRIEF DESCRIPTION OF DRAWINGS

The above-mentioned aspects of exemplary embodiments will become more apparent and will be better understood by reference to the following description of the embodiments taken in conjunction with the accompanying drawings, wherein.

DETAILED DESCRIPTION

Figure 1:
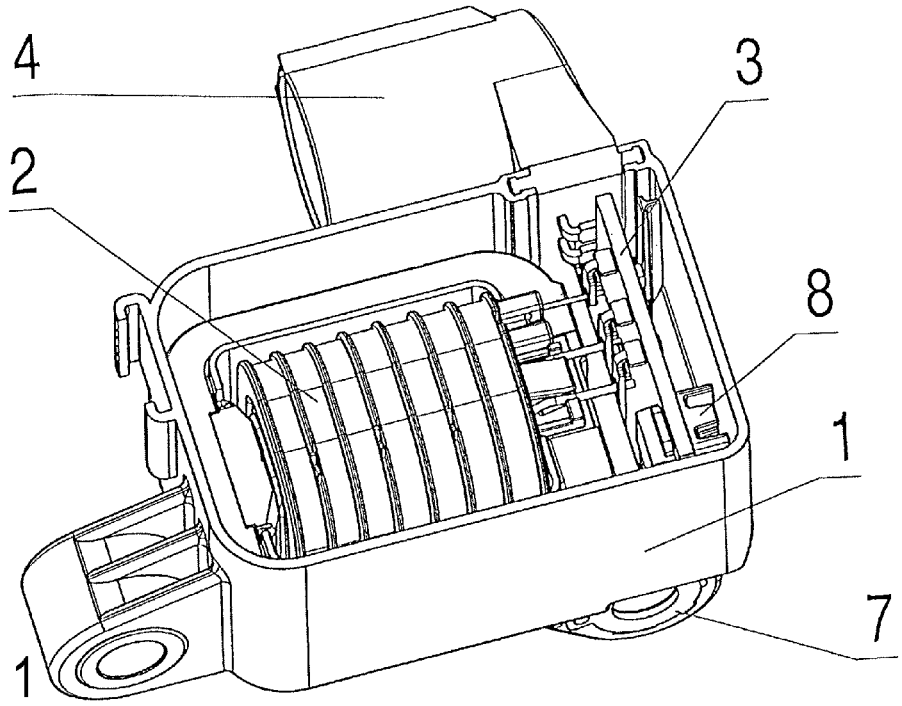
FIG. 1 shows an illustrative embodiment of an ignition device with opened housing without potting.
Figure 2:
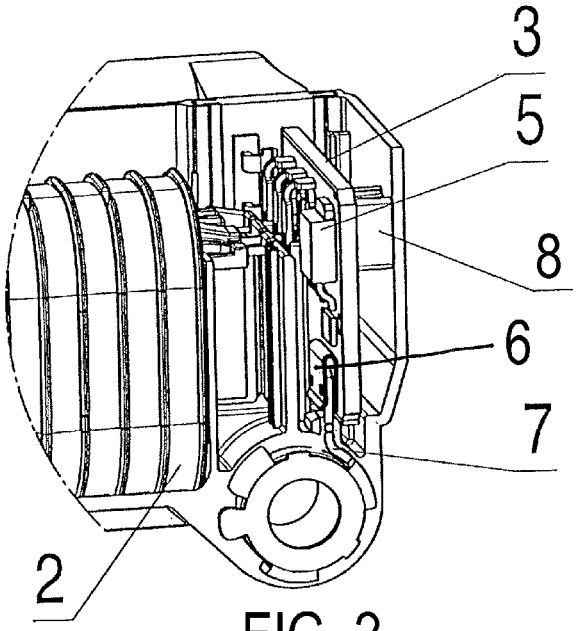
FIG. 2 shows a detail of a sectional view of FIG. 1.
Figure 3:
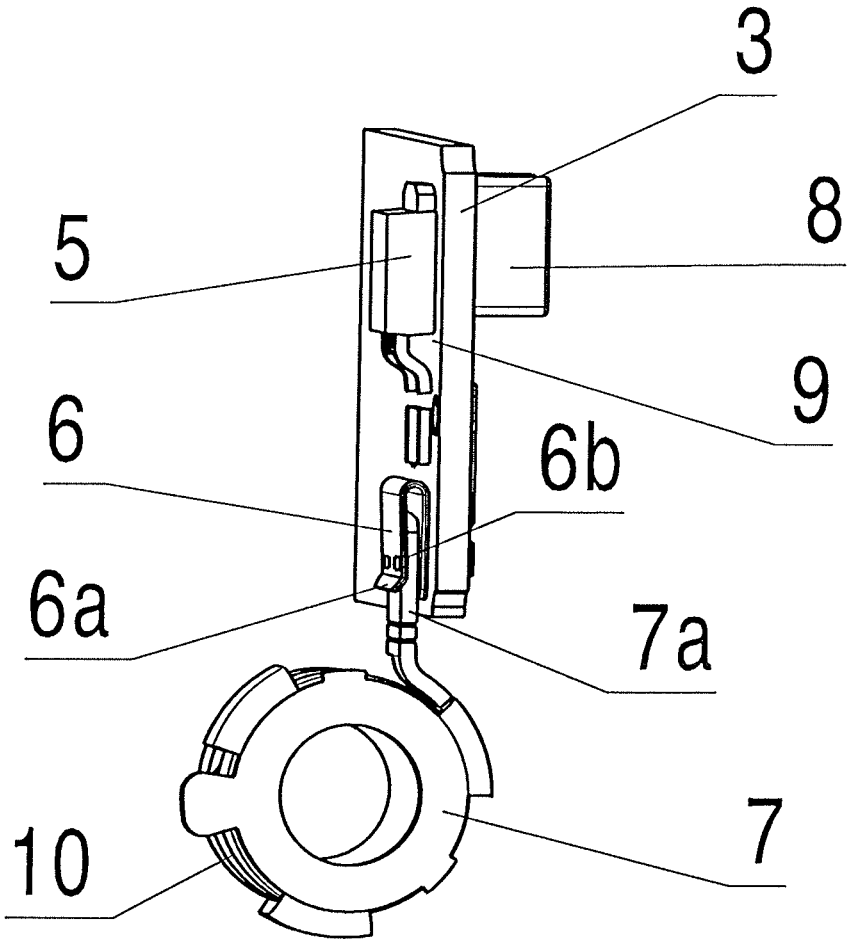
FIG. 3 shows the printed circuit board of the ignition device with control circuit, cooling body and thermal dissipation element.

The embodiments described below are not intended to be exhaustive or to limit the invention to the precise forms disclosed in the following detailed description. Rather, the embodiments are chosen and described so that others skilled in the art may appreciate and understand the principles and practices of the present invention.

The ignition device illustrated in the figures has a plastic housing 1, in which an ignition coil 2 with primary and secondary windings and also a printed circuit board 3, which carries a control circuit, are arranged. The plastic housing 1 comprises a plug connector 4 for connection of the ignition device to the on-board power supply of a vehicle.

The control circuit contains a power transistor 5 and therefore generates a considerable thermal loss during operation. In order to dissipate this loss, a cooling body 6 is soldered onto a metal surface, generally a copper surface, of the printed circuit board 1, for example, by means of SMD technology. The cooling body 6 is plugged together with a thermal dissipation element 7, which protrudes through a wall of the plastic housing 1. The cooling body 6 and thermal dissipation element 7 together form a thermal bridge, which dissipates the thermal loss of the control circuit outside of the plastic housing 1. Waste heat of the control circuit, in particular, of the power transistor 5, therefore first flows over the copper surface of the printed circuit board 3 to the cooling body 6, and from there flows over the thermal dissipation element 7 and out from the housing 1.

The thermal dissipation element 7 may be embedded in a wall of the plastic housing 1, for example, by producing the plastic housing 1 by means of injection molding and, in so doing, insert molding the thermal dissipation element 7 with plastic. The thermal dissipation element 7 is intended to be fastened on an engine block of a vehicle. To this end, the thermal dissipation element 7 can be rigidly connected over a large area to a bushing 10. It is also possible for the thermal dissipation element 7 to form an eyelet or bushing 10. By means of this eyelet or bushing 10, the thermal dissipation element can be pushed onto a pin of the engine block provided for this purpose and can thus be cooled by coolant flowing through the engine block.

The cooling body 6 soldered onto the metal surface of the printed circuit board 3 is a strip bent in a U-shaped manner, which comprises two branches. One of these branches is soldered to the metal surface of the printed circuit board 3. The other branch, which faces away from the printed circuit board 3, may comprise an erect end portion 6*a*, in order to facilitate the insertion of a portion 7*a* of the thermal dissipation element 7. The thermal dissipation element 7, for example, may comprise a tongue or strip-shaped portion 7*a*, which is clamped between the two branches of the cooling body 6.

The cooling body 6 and the thermal dissipation element 7 form a tongue and groove connection, wherein the tongue is clamped in the groove. The groove is provided by the U-shaped strip.

In the illustrative embodiment shown, the branch of the cooling body 6 facing away from the printed circuit board 3 comprises a protrusion 6*b*, which faces towards the other branch and facilitates the fixing of the thermal dissipation element 7. The cooling body 6 is preferably arranged on the same side of the printed circuit board 3 as the power transistor 5, but may also be on the opposite side.

Both the thermal dissipation element 7 and the cooling body 6 can be produced cost effectively from sheet metal.

The power transistor 5 of the control circuit may additionally be coupled to a cooling body 8. In the illustrative embodiment shown, the power transistor 5 is coupled via thermal conduction paths 9 to the cooling body 8, which is arranged in the plastic housing 1 on the side of the printed circuit board 3 facing away from the power transistor 5. An additional cooling body 8 may also be arranged however at another location in the plastic housing 1.

The cooling body 8 typically has a sheet metal portion, which forms a cooling face bearing against a wall of the plastic housing 1. For example, the sheet metal portion can bear resiliently against the housing wall or can extend at least along the housing wall by being fastened via a bent portion to the printed circuit board 3. The cooling body 8 can be produced cost effectively as a sheet metal part that plugs into the printed circuit board 3 via extensions and is thus coupled thermally to the power transistor 5.

While exemplary embodiments have been disclosed hereinabove, the present invention is not limited to the disclosed embodiments. Instead, this application is intended to cover any variations, uses, or adaptations of this disclosure using the general principles taught herein. Further, this application is intended to cover such departures from the present disclosure as come within known or customary practice in the art to which this invention pertains and which fall within the limits of the appended claims.

What is claimed is:

1. An ignition device for an Otto engine, comprising:
an ignition coil;
a printed circuit board, which carries a control circuit comprising a power transistor;
a plastic housing in which the ignition coil and the printed circuit board are arranged; and
a thermal dissipation element, which protrudes through a wall of the plastic housing;
wherein the printed circuit board carries a cooling body plugged together with the thermal dissipation element to form a thermal bridge, which dissipates thermal losses of the control circuit from the plastic housing;
wherein the thermal dissipation element comprises a connector that connects the thermal dissipation element to an engine block; and
wherein the thermal dissipation element comprises a bushing spaced away from and connected to the circuit board via a strip that is plugged to the circuit board.

2. The ignition device according to claim 1, wherein the cooling body is soldered onto a metal surface of the printed circuit board.

3. The ignition device according to claim 1, wherein the cooling body is arranged on the same side of the printed circuit board as the power transistor.

4. The ignition device according to claim 1, wherein the thermal dissipation element electrically connects the control circuit to the vehicle ground potential.

5. The ignition device according to claim 1, wherein the thermal dissipation element and the cooling body form a tongue and groove connection.

6. The ignition device according to claim 1, wherein the thermal dissipation element clamps the cooling body or the cooling body clamps the thermal dissipation element.

7. The ignition device according to claim 1, wherein the cooling body is a strip bent in a U-shaped manner having two branches holding the thermal dissipation element between the two branches.

8. The ignition device according to claim 7, wherein the thermal dissipation element is clamped between the two branches.

9. The ignition device according to claim 7, wherein the branch facing away from the printed circuit board comprises an erect end portion at its free end.

10. The ignition device according to claim 7, wherein the branch facing away from the printed circuit board has a protrusion facing towards the other branch.

11. The ignition device according to claim 7, wherein the branch facing away from the printed circuit board has a kink, which forms a protrusion facing towards the other branch.

12. The ignition device according to claim 1, wherein the thermal dissipation element comprises an eyelet for fastening the ignition device on an engine block.

13. The ignition device according to claim 1, wherein the cooling body and the thermal dissipation element are formed from sheet metal.

14. The ignition device according to claim 1, wherein the power transistor is coupled to a further cooling body.

15. An ignition device for an Otto engine, comprising:

an ignition coil;

a printed circuit board carrying a control circuit comprising a power transistor;

a plastic housing in which the ignition coil and the printed circuit board are arranged;

a thermal dissipation element protruding through a wall of the plastic housing, the thermal dissipation element being adapted to be fastened on an engine block of a vehicle; and a cooling body carried by the printed circuit board;

wherein one of the thermal dissipation element and cooling body is clamped to the other to form a thermal bridge, whereby heat generated by the control circuit is transferred outside of the plastic housing;

further wherein, the thermal dissipation element comprises a bushing configured to mount the ignition device to the engine block.

16. The ignition device according to claim 15, wherein the cooling body comprises a strip bent in a U-shape having two branches and the thermal dissipation element is clamped between the two branches.

17. The ignition device according to claim 16, wherein the branch facing away from the printed circuit board comprises an erect end portion at its free end.

18. The ignition device according to claim 16, wherein the branch facing away from the printed circuit board has a protrusion facing towards the other branch.

19. The ignition device according to claim 16, wherein the branch facing away from the printed circuit board has a kink, which forms a protrusion facing towards the other branch.

20. An ignition device for an Otto engine, comprising:

an ignition coil;

a printed circuit board, which carries a control circuit comprising a power transistor;

a plastic housing in which the ignition coil and the printed circuit board are arranged; and a thermal dissipation element, which protrudes through a wall of the plastic housing;

wherein the printed circuit board carries a cooling body plugged together with the thermal dissipation element to form a thermal bridge, which dissipates thermal losses of the control circuit from the plastic housing; and wherein the thermal dissipation element comprises a bushing embedded in the plastic housing, the thermal dissipation element configured to receive a connector that connects the thermal dissipation element to the engine block.

21. An ignition device for an Otto engine, comprising:

an ignition coil;

a printed circuit board, which carries a control circuit comprising a power transistor;

a plastic housing in which the ignition coil and the printed circuit board are arranged; and a thermal dissipation element, which protrudes through a wall of the plastic housing;

wherein the printed circuit board carries a cooling body plugged together with the thermal dissipation element to form a thermal bridge, which dissipates thermal losses of the control circuit from the plastic housing;

wherein the power transistor is coupled to a further cooling body; and wherein the thermal dissipation element is configured to be pushed onto a pin of the engine block and thereby cooled by coolant flowing through the engine block.

22. The ignition device according to claim 21, wherein the printed circuit board is arranged between the further cooling body and the power transistor.

* * * * *